US008038411B2

(12) United States Patent
Shafique et al.

(10) Patent No.: US 8,038,411 B2
(45) Date of Patent: Oct. 18, 2011

(54) COMPRESSOR TURBINE BLADE AIRFOIL PROFILE

(75) Inventors: Harris Shafique, Longueuil (CA); Marc Tardif, Candiac (CA); Dimitrios Garinis, Montreal (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 672 days.

(21) Appl. No.: 12/172,488

(22) Filed: Jul. 14, 2008

(65) Prior Publication Data

US 2010/0008784 A1 Jan. 14, 2010

(51) Int. Cl.
*B63H 1/26* (2006.01)
*B63H 7/02* (2006.01)

(52) U.S. Cl. ..... 416/243; 416/DIG. 2

(58) Field of Classification Search ..... 415/191, 415/208.1, 208.2, 211.2; 416/223 R, 223 A, 416/243, DIG. 2, DIG. 5
See application file for complete search history.

(56) References Cited

U.S. PATENT DOCUMENTS

| | | | | |
|---|---|---|---|---|
| 6,398,489 | B1 | 6/2002 | Burdgick et al. | |
| 6,832,897 | B2 | 12/2004 | Urban | |
| 6,854,961 | B2 | 2/2005 | Zhang et al. | |
| 6,910,868 | B2 | 6/2005 | Hyde et al. | |
| 7,513,749 | B2 * | 4/2009 | Duong et al. | 416/223 A |
| 2003/0017052 | A1 * | 1/2003 | Frost et al. | 416/223 A |
| 2003/0021680 | A1 * | 1/2003 | Bielek et al. | 415/191 |
| 2005/0079061 | A1 | 4/2005 | Beddard | |
| 2008/0240924 | A1 * | 10/2008 | Kizuka et al. | 416/223 R |
| 2008/0273984 | A1 * | 11/2008 | Liang et al. | 416/223 R |

OTHER PUBLICATIONS

U.S. Appl. No. 11/366,018, filed Mar. 2, 2006, Girgis et al.
U.S. Appl. No. 11/366,025, filed Mar. 2, 2006, Girgis et al.
U.S. Appl. No. 11/366,020, filed Mar. 2, 2006, Girgis et al.
U.S. Appl. No. 11/366,015, filed Mar. 2, 2006, Girgis et al.
U.S. Appl. No. 11/366,026, filed Mar. 2, 2006, Girgis et al.
U.S. Appl. No. 11/514,987, filed Sep. 5, 2006, Marini et al.
U.S. Appl. No. 11/514,983, filed Sep. 5, 2006, Ravanis et al.
U.S. Appl. No. 11/514,990, filed Sep. 5, 2006, Tsifourdaris et al.
U.S. Appl. No. 11/514,989, filed Sep. 5, 2006, Girgis et al.
U.S. Appl. No. 11/514,972, filed Sep. 5, 2006, Mah et al.
U.S. Appl. No. 11/470,416, filed Sep. 6, 2006, Trindade et al.
U.S. Appl. No. 11/516,598, filed Sep. 7, 2006, Papple et al.
U.S. Appl. No. 11/516,601, filed Sep. 7, 2006, Sleiman et al.
U.S. Appl. No. 11/516,599, filed Sep. 7, 2006, Sreekanth et al.
U.S. Appl. No. 11/563,839, filed Nov. 28, 2006, Marini et al.
U.S. Appl. No. 11/563,808, filed Nov. 28, 2006, Ravanis et al.
U.S. Appl. No. 11/563,801, filed Nov. 28, 2006, Kidikian et al.
U.S. Appl. No. 11/563,797, filed Nov. 28, 2006, Kidikian et al.
U.S. Appl. No. 11/563,783, filed Nov. 28, 2006, Kidikian et al.
U.S. Appl. No. 11/562,604, filed Nov. 22, 2006, Mohan et al.
U.S. Appl. No. 11/562,556, filed Nov. 22, 2006, Mohan et al.
U.S. Appl. No. 11/562,577, filed Nov. 22, 2006, Findlay et al.
U.S. Appl. No. 11/562,502, filed Nov. 22, 2006, Tsifourdaris et al.
U.S. Appl. No. 11/562,516, filed Nov. 22, 2006, Mohan et al.

* cited by examiner

*Primary Examiner* — Michelle Estrada
(74) *Attorney, Agent, or Firm* — Norton Rose OR LLP

(57) ABSTRACT

A turbine blade includes an airfoil having a profile substantially in accordance with at least an intermediate portion of the Cartesian coordinate values of X, Y and Z set forth in Table 1. The X and Y values are distances, which when smoothly connected by an appropriate continuing curve, define airfoil profile sections at each distance Z. The profile sections at each distance Z arc joined smoothly to one another to form a complete airfoil shape.

15 Claims, 2 Drawing Sheets

COMPRESSOR TURBINE BLADE AIRFOIL PROFILE

TECHNICAL FIELD

The invention relates generally to a blade airfoil for a gas turbine engine and, more particularly, to an airfoil profile suited for a high pressure turbine (HPT) stage blade.

BACKGROUND OF THE ART

Improving the dynamic behaviour of a turbine blade without adversely affecting the overall aerodynamic performance of the turbine has always been challenging. For instance, various approaches have been proposed for reducing airfoil vibrations in order to prevent premature failure of turbine blades. However, the various solutions proposed heretofore have never been fully satisfactory and often come at the cost of a detrimental impact on the engine performance.

SUMMARY

It is therefore an object of this invention to provide an improved airfoil for a turbine profile which addresses the above mentioned concerns.

In one aspect, there is provided a turbine blade for a gas turbine engine comprising an airfoil having an intermediate portion defined by a nominal profile substantially in accordance with Cartesian coordinate values of X, Y, and Z set forth in Table 1, wherein the point of origin of the orthogonally related axes X, Y and Z is located at an intersection of a centerline of the gas turbine engine and a stacking line of the turbine blade, the Z values are radial distances measured along the stacking line, the X and Y are coordinate values defining the profile at each distance Z.

In another aspect, there is provided a turbine blade for a gas turbine engine comprising an airfoil having a gaspath portion at least partly defined by a nominal profile substantially in accordance with Cartesian coordinate values of X, Y, and Z set forth in Table 1, wherein the point of origin of the orthogonally related axes X, Y and Z is located at an intersection of a centerline of the gas turbine engine and a stacking line of the turbine blade in the engine, the Z values are radial distances measured along the stacking line of the airfoil, the X and Y are coordinate values defining the profile at each distance Z, and wherein the X and Y values are scalable as a function of the same constant or number.

In another aspect, there is provided a turbine rotor for a gas turbine engine comprising a plurality of blades extending from a rotor disc, each blade including an airfoil having an intermediate portion defined by a nominal profile substantially in accordance with Cartesian coordinate values of X, Y, and Z set forth in Table 1, wherein the point of origin of the orthogonally related axes X, Y and Z is located at an intersection of a centerline of the gas turbine engine and a stacking line of the blades, the Z values are radial distances measured along the stacking line, the X and Y are coordinate values defining the profile at each distance Z.

In accordance with a still further general aspect, there is provided a high pressure blade adapted to be mounted in a gaspath comprising a stacking line, the stacking line defining the position of the blade in the gaspath, the blade being provided with an airfoil having a surface lying substantially on the points of Table 1.

DESCRIPTION OF THE DRAWINGS

Reference is now made to the accompanying figures in which.

DETAILED DESCRIPTION OF THE PREFERRED EMBODIMENTS

A turboprop engine of a type preferably provided for use in subsonic flight, generally comprises in serial flow communication a centrifugal compressor for pressurizing the air, a combustor in which the compressed air is mixed with fuel and ignited for generating an annular stream of hot combustion gases, and a turbine section for extracting energy from the combustion gases. The turbine section can comprise a single stage compressor turbine 20 followed by a power turbine (not shown). The compressor turbine 20 drives the compressor, whereas the power turbine 22 drives an output shaft.

Figure 1:
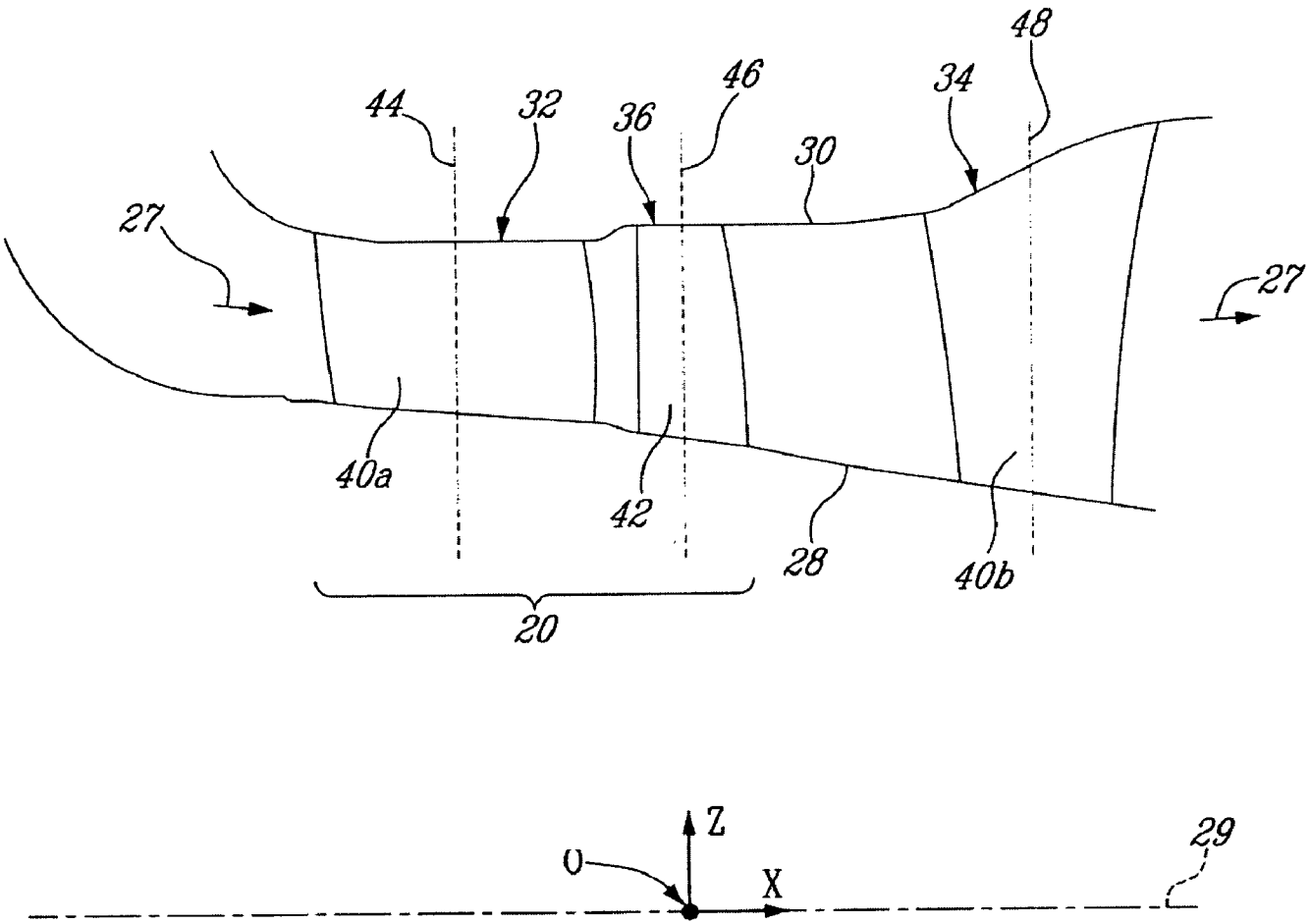
FIG. 1 is a schematic view of a gaspath of a gas turbine engine, including a high pressure turbine stage.

FIG. 1 illustrates a portion of an annular hot gaspath, indicated by arrows 27 and defined by annular inner and outer walls 28 and 30 respectively, for directing the stream of hot combustion gases axially in an annular flow through the compressor turbine 20. The compressor turbine 20 comprises a High Pressure Turbine (HPT) stage which is preferably transonic and which comprises a stator assembly 32 and a rotor assembly 36 having a plurality of circumferentially spaced vanes 40*a* and blades 42 respectively. The vanes 40*a* and blades 42 are mounted in position along respective stacking lines 44 and 46, as identified in FIG. 1. Another stator vane assembly 34 is disposed downstream of the first stage of turbine blades 42 and comprises a circumferential array of turbine vane 40*b* mounted relative to a stacking line 48. The stacking lines 44, 46 and 48 extend in the radial direction along the z axis at different axial locations. The stacking lines 44, 46 and 48 define the axial location where the vanes 40*a*, the blades 42 and the vanes 40*b* are mounted in the engine.

The rotor assembly 36 includes a disc (not shown) drivingly mounted to the engine shaft. The disc carries at its periphery a plurality of circumferentially distributed blades similar the one shown at 42 in FIG. 2. The blades 42 extend radially outwardly into the gaspath 27. The HPT includes 14 HP vanes 40*a* and 58 HP blades 42.

Figure 2:
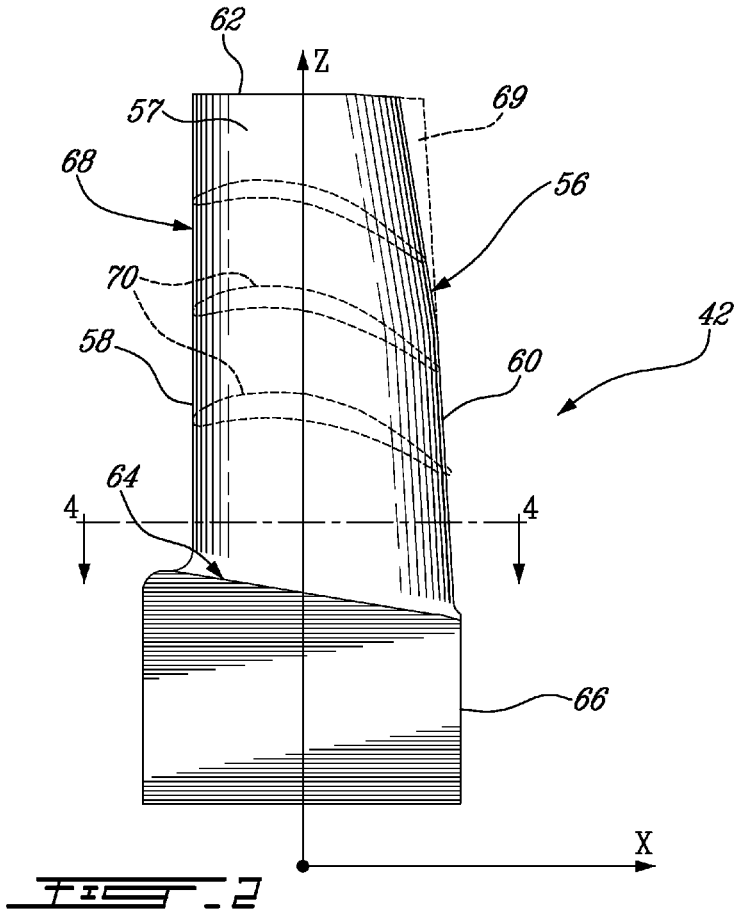
FIG. 2 is a schematic elevation view of a HPT stage blade having a blade profile defined in accordance with an embodiment of the present invention.
Figure 3:
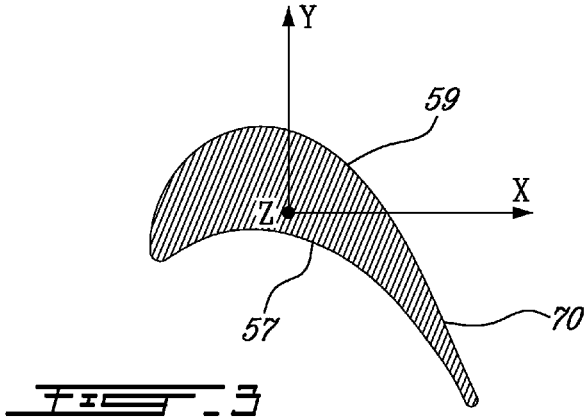
FIG. 3 is a cross sectional view taken along lines 3-3 of FIG. 2, showing a representative profile section of the airfoil portion of the blade.

FIG. 2 shows an example of one of the blades 42 of the HPT stage. It can be seen that each blade 42 has an airfoil 56 having a pressure side 57 and a suction side 59 (FIG. 3) extending between a leading edge 58 and a trailing edge 60. The airfoil 56 extends from a platform 64 to a tip 62. The platform 64 is provided at the upper end of a root portion 66. The root portion 66 is adapted to be captively received in a complementary blade attachment slot (not shown) defined in the outer periphery of the turbine disc such that it resists axial and centrifugal dislodgement of the blade 42.

The novel airfoil shape of each HPT stage blade 42 is defined by a set of X-Y-Z points in space. This set of points represents a novel and unique solution to the target design criteria discussed above, and is well-adapted for use in a single-stage HPT design. The set of points are defined in a Cartesian coordinate system which has mutually orthogonal X, Y and Z axes. The X axis extends axially along the turbine rotor centerline 29 i.e., the rotary axis. The positive X direction is axially towards the aft of the turbine engine. The Z axis extends along the HPT blade stacking line 46 of each respective blade 42 in a generally radial direction and intersects the X axis at the center of rotation of the rotor assembly 36. The positive Z direction is radially outwardly toward the blade tip 62. The Y axis extends perpendicularly to the XZ plane with the positive Y direction 90 degrees counterclockwise from the positive X direction. Therefore, the origin of the X, Y and Z axes is defined at the point of intersection of all three orthogonally-related axes: that is the point (0,0,0) at the intersection of the center of rotation of the turbine engine and the stacking line 46.

In a particular embodiment of the HPT stage, the set of points which define the HPT stage blade airfoil profile relative to the axis of rotation of the turbine engine 10 and the stacking line 46 thereof are set out in Table 1 below as X, Y and Z Cartesian coordinate values. Particularly, the blade airfoil profile is defined by profile sections 70 at various locations along its height, the locations represented by Z values. It should be understood that the Z values do not represent an actual radial height along the airfoil 56 but are defined with respect to the engine center line. For example, if the blades 42 are mounted about the rotor assembly 36 at an angle with respect to the radial direction, then the Z values are not a true representation of the height of the airfoils of the blades 42. Furthermore, it is to be appreciated that, with respect to Table 1, Z values are not actually radial heights, per se, from the centerline but rather a height from a plane through the centerline—i.e. the sections in Table 1 are planar. The coordinate values are set forth in inches in Table 1 although other units of dimensions may be used when the values are appropriately converted.

Thus, at each Z distance, the X and Y coordinate values of the desired profile section 70 are defined at selected locations in a Z direction normal to the X, Y plane. The X and Y coordinates are given in distance dimensions, e.g., units of inches, and are joined smoothly, using appropriate curve-fitting techniques, at each Z location to form a continuous airfoil cross-section. The blade airfoil profiles of the various surface locations between the distances Z are determined by smoothly connecting the adjacent profile sections 70 to one another to form the airfoil profile.

The coordinate values listed in Table 1 below represent the desired airfoil profiles in a "cold" (i.e. non-operating) condition. However, the manufactured airfoil surface profile will be slightly different as a result of manufacturing and applied coating tolerances. The coordinate values listed in Table 1 below are for an uncoated airfoil. According to an embodiment of the present invention, the finished HPT blades are coated for oxidation and thermal protection.

The Table 1 values are generated and shown to three decimal places for determining the profile of the HPT stage blade airfoil. However, as mentioned above, there are manufacturing tolerance issues, as well as coating thicknesses, which must be accounted for and, accordingly, the values for the profile given in Table 1 are for a theoretical airfoil, to which a ±0.003 inch manufacturing tolerance is additive to the profile defined by the X and Y values given in Table 1 below. A coating having a thickness of 0.001 inch to 0.002 inch is typically applied to the uncoated blade airfoil defined in Table 1. The HPT stage blade airfoil design functions well within these ranges. The cold or room temperature profile is given by the X, Y and Z coordinates for manufacturing purposes. It is understood that the airfoil may deform, within acceptable limits, once entering service.

The coordinate values given in Table 1 below provide the preferred nominal HPT stage blade airfoil profile.

TABLE 1

| | X | Y | Z |
|---|---|---|---|
| SECTION 1 | −0.202 | −0.084 | 3.350 |
| | −0.215 | −0.077 | 3.350 |
| | −0.219 | −0.063 | 3.350 |
| | −0.218 | −0.047 | 3.350 |

TABLE 1-continued

| | X | Y | Z |
|---|---|---|---|
| | −0.217 | −0.032 | 3.350 |
| | −0.214 | −0.017 | 3.350 |
| | −0.210 | −0.002 | 3.350 |
| | −0.205 | 0.012 | 3.350 |
| | −0.200 | 0.027 | 3.350 |
| | −0.193 | 0.040 | 3.350 |
| | −0.185 | 0.053 | 3.350 |
| | −0.176 | 0.066 | 3.350 |
| | −0.166 | 0.078 | 3.350 |
| | −0.155 | 0.089 | 3.350 |
| | −0.144 | 0.099 | 3.350 |
| | −0.131 | 0.108 | 3.350 |
| | −0.118 | 0.116 | 3.350 |
| | −0.104 | 0.123 | 3.350 |
| | −0.090 | 0.128 | 3.350 |
| | −0.075 | 0.132 | 3.350 |
| | −0.060 | 0.135 | 3.350 |
| | −0.045 | 0.136 | 3.350 |
| | −0.029 | 0.136 | 3.350 |
| | −0.014 | 0.134 | 3.350 |
| | 0.001 | 0.131 | 3.350 |
| | 0.016 | 0.126 | 3.350 |
| | 0.030 | 0.121 | 3.350 |
| | 0.044 | 0.114 | 3.350 |
| | 0.057 | 0.106 | 3.350 |
| | 0.070 | 0.098 | 3.350 |
| | 0.082 | 0.088 | 3.350 |
| | 0.094 | 0.078 | 3.350 |
| | 0.105 | 0.068 | 3.350 |
| | 0.116 | 0.057 | 3.350 |
| | 0.126 | 0.045 | 3.350 |
| | 0.136 | 0.033 | 3.350 |
| | 0.145 | 0.021 | 3.350 |
| | 0.154 | 0.009 | 3.350 |
| | 0.163 | −0.004 | 3.350 |
| | 0.171 | −0.017 | 3.350 |
| | 0.179 | −0.030 | 3.350 |
| | 0.187 | −0.043 | 3.350 |
| | 0.194 | −0.057 | 3.350 |
| | 0.201 | −0.070 | 3.350 |
| | 0.208 | −0.084 | 3.350 |
| | 0.215 | −0.098 | 3.350 |
| | 0.222 | −0.112 | 3.350 |
| | 0.228 | −0.126 | 3.350 |
| | 0.235 | −0.140 | 3.350 |
| | 0.241 | −0.154 | 3.350 |
| | 0.248 | −0.168 | 3.350 |
| | 0.254 | −0.182 | 3.350 |
| | 0.260 | −0.196 | 3.350 |
| | 0.266 | −0.210 | 3.350 |
| | 0.272 | −0.224 | 3.350 |
| | 0.279 | −0.238 | 3.350 |
| | 0.285 | −0.252 | 3.350 |
| | 0.291 | −0.266 | 3.350 |
| | 0.297 | −0.280 | 3.350 |
| | 0.300 | −0.295 | 3.350 |
| | 0.287 | −0.300 | 3.350 |
| | 0.279 | −0.287 | 3.350 |
| | 0.272 | −0.274 | 3.350 |
| | 0.265 | −0.260 | 3.350 |
| | 0.257 | −0.247 | 3.350 |
| | 0.248 | −0.234 | 3.350 |
| | 0.239 | −0.221 | 3.350 |
| | 0.230 | −0.209 | 3.350 |
| | 0.221 | −0.197 | 3.350 |
| | 0.211 | −0.185 | 3.350 |
| | 0.202 | −0.173 | 3.350 |
| | 0.192 | −0.161 | 3.350 |
| | 0.182 | −0.149 | 3.350 |
| | 0.171 | −0.138 | 3.350 |
| | 0.160 | −0.127 | 3.350 |
| | 0.149 | −0.117 | 3.350 |
| | 0.137 | −0.107 | 3.350 |
| | 0.125 | −0.098 | 3.350 |
| | 0.113 | −0.089 | 3.350 |
| | 0.100 | −0.080 | 3.350 |
| | 0.087 | −0.072 | 3.350 |
| | 0.073 | −0.065 | 3.350 |

TABLE 1-continued

| | X | Y | Z |
|---|---|---|---|
| | 0.059 | −0.058 | 3.350 |
| | 0.045 | −0.052 | 3.350 |
| | 0.031 | −0.047 | 3.350 |
| | 0.016 | −0.043 | 3.350 |
| | 0.001 | −0.039 | 3.350 |
| | −0.014 | −0.036 | 3.350 |
| | −0.029 | −0.033 | 3.350 |
| | −0.044 | −0.032 | 3.350 |
| | −0.060 | −0.032 | 3.350 |
| | −0.075 | −0.033 | 3.350 |
| | −0.090 | −0.034 | 3.350 |
| | −0.105 | −0.037 | 3.350 |
| | −0.120 | −0.042 | 3.350 |
| | −0.135 | −0.047 | 3.350 |
| | −0.149 | −0.053 | 3.350 |
| | −0.162 | −0.061 | 3.350 |
| | −0.175 | −0.069 | 3.350 |
| | −0.188 | −0.078 | 3.350 |
| SECTION 2 | −0.204 | −0.064 | 3.510 |
| | −0.216 | −0.056 | 3.510 |
| | −0.218 | −0.041 | 3.510 |
| | −0.218 | −0.026 | 3.510 |
| | −0.216 | −0.011 | 3.510 |
| | −0.212 | 0.004 | 3.510 |
| | −0.207 | 0.019 | 3.510 |
| | −0.200 | 0.033 | 3.510 |
| | −0.193 | 0.046 | 3.510 |
| | −0.185 | 0.059 | 3.510 |
| | −0.176 | 0.072 | 3.510 |
| | −0.166 | 0.083 | 3.510 |
| | −0.155 | 0.094 | 3.510 |
| | −0.143 | 0.104 | 3.510 |
| | −0.130 | 0.113 | 3.510 |
| | −0.117 | 0.120 | 3.510 |
| | −0.103 | 0.126 | 3.510 |
| | −0.088 | 0.131 | 3.510 |
| | −0.073 | 0.134 | 3.510 |
| | −0.058 | 0.136 | 3.510 |
| | −0.042 | 0.136 | 3.510 |
| | −0.027 | 0.135 | 3.510 |
| | −0.012 | 0.132 | 3.510 |
| | 0.003 | 0.128 | 3.510 |
| | 0.017 | 0.122 | 3.510 |
| | 0.031 | 0.115 | 3.510 |
| | 0.045 | 0.108 | 3.510 |
| | 0.057 | 0.099 | 3.510 |
| | 0.070 | 0.090 | 3.510 |
| | 0.081 | 0.080 | 3.510 |
| | 0.093 | 0.070 | 3.510 |
| | 0.103 | 0.058 | 3.510 |
| | 0.114 | 0.047 | 3.510 |
| | 0.123 | 0.035 | 3.510 |
| | 0.133 | 0.023 | 3.510 |
| | 0.141 | 0.010 | 3.510 |
| | 0.150 | −0.003 | 3.510 |
| | 0.158 | −0.016 | 3.510 |
| | 0.166 | −0.029 | 3.510 |
| | 0.174 | −0.042 | 3.510 |
| | 0.181 | −0.056 | 3.510 |
| | 0.188 | −0.069 | 3.510 |
| | 0.195 | −0.083 | 3.510 |
| | 0.202 | −0.097 | 3.510 |
| | 0.208 | −0.111 | 3.510 |
| | 0.215 | −0.125 | 3.510 |
| | 0.221 | −0.139 | 3.510 |
| | 0.227 | −0.153 | 3.510 |
| | 0.234 | −0.167 | 3.510 |
| | 0.240 | −0.181 | 3.510 |
| | 0.246 | −0.195 | 3.510 |
| | 0.252 | −0.209 | 3.510 |
| | 0.258 | −0.223 | 3.510 |
| | 0.264 | −0.238 | 3.510 |
| | 0.270 | −0.252 | 3.510 |
| | 0.276 | −0.266 | 3.510 |
| | 0.283 | −0.280 | 3.510 |
| | 0.289 | −0.294 | 3.510 |
| | 0.293 | −0.309 | 3.510 |
| | 0.282 | −0.316 | 3.510 |

TABLE 1-continued

| | X | Y | Z |
|---|---|---|---|
| | 0.273 | −0.305 | 3.510 |
| | 0.266 | −0.291 | 3.510 |
| | 0.259 | −0.277 | 3.510 |
| | 0.251 | −0.264 | 3.510 |
| | 0.243 | −0.251 | 3.510 |
| | 0.235 | −0.238 | 3.510 |
| | 0.226 | −0.225 | 3.510 |
| | 0.218 | −0.212 | 3.510 |
| | 0.209 | −0.200 | 3.510 |
| | 0.200 | −0.187 | 3.510 |
| | 0.191 | −0.175 | 3.510 |
| | 0.182 | −0.162 | 3.510 |
| | 0.172 | −0.150 | 3.510 |
| | 0.163 | −0.138 | 3.510 |
| | 0.152 | −0.127 | 3.510 |
| | 0.142 | −0.116 | 3.510 |
| | 0.131 | −0.105 | 3.510 |
| | 0.119 | −0.094 | 3.510 |
| | 0.108 | −0.085 | 3.510 |
| | 0.095 | −0.075 | 3.510 |
| | 0.083 | −0.066 | 3.510 |
| | 0.070 | −0.058 | 3.510 |
| | 0.056 | −0.050 | 3.510 |
| | 0.043 | −0.043 | 3.510 |
| | 0.029 | −0.037 | 3.510 |
| | 0.015 | −0.031 | 3.510 |
| | 0.000 | −0.026 | 3.510 |
| | −0.015 | −0.022 | 3.510 |
| | −0.030 | −0.019 | 3.510 |
| | −0.045 | −0.017 | 3.510 |
| | −0.060 | −0.015 | 3.510 |
| | −0.076 | −0.016 | 3.510 |
| | −0.091 | −0.017 | 3.510 |
| | −0.106 | −0.020 | 3.510 |
| | −0.121 | −0.024 | 3.510 |
| | −0.136 | −0.029 | 3.510 |
| | −0.150 | −0.035 | 3.510 |
| | −0.163 | −0.042 | 3.510 |
| | −0.177 | −0.050 | 3.510 |
| | −0.190 | −0.058 | 3.510 |
| SECTION 3 | −0.205 | −0.044 | 3.670 |
| | −0.217 | −0.036 | 3.670 |
| | −0.218 | −0.021 | 3.670 |
| | −0.217 | −0.005 | 3.670 |
| | −0.214 | 0.010 | 3.670 |
| | −0.209 | 0.024 | 3.670 |
| | −0.202 | 0.038 | 3.670 |
| | −0.194 | 0.052 | 3.670 |
| | −0.186 | 0.064 | 3.670 |
| | −0.177 | 0.077 | 3.670 |
| | −0.167 | 0.088 | 3.670 |
| | −0.155 | 0.099 | 3.670 |
| | −0.143 | 0.108 | 3.670 |
| | −0.130 | 0.116 | 3.670 |
| | −0.117 | 0.123 | 3.670 |
| | −0.102 | 0.129 | 3.670 |
| | −0.087 | 0.133 | 3.670 |
| | −0.072 | 0.136 | 3.670 |
| | −0.057 | 0.137 | 3.670 |
| | −0.042 | 0.136 | 3.670 |
| | −0.026 | 0.133 | 3.670 |
| | −0.011 | 0.130 | 3.670 |
| | 0.003 | 0.125 | 3.670 |
| | 0.017 | 0.118 | 3.670 |
| | 0.031 | 0.111 | 3.670 |
| | 0.043 | 0.102 | 3.670 |
| | 0.056 | 0.093 | 3.670 |
| | 0.068 | 0.083 | 3.670 |
| | 0.079 | 0.073 | 3.670 |
| | 0.090 | 0.062 | 3.670 |
| | 0.100 | 0.050 | 3.670 |
| | 0.109 | 0.038 | 3.670 |
| | 0.119 | 0.026 | 3.670 |
| | 0.128 | 0.014 | 3.670 |
| | 0.136 | 0.001 | 3.670 |
| | 0.144 | −0.012 | 3.670 |
| | 0.152 | −0.026 | 3.670 |
| | 0.159 | −0.039 | 3.670 |

TABLE 1-continued

| | X | Y | Z |
|---|---|---|---|
| | 0.167 | −0.053 | 3.670 |
| | 0.174 | −0.066 | 3.670 |
| | 0.181 | −0.080 | 3.670 |
| | 0.187 | −0.094 | 3.670 |
| | 0.194 | −0.108 | 3.670 |
| | 0.200 | −0.122 | 3.670 |
| | 0.206 | −0.136 | 3.670 |
| | 0.212 | −0.150 | 3.670 |
| | 0.219 | −0.164 | 3.670 |
| | 0.225 | −0.178 | 3.670 |
| | 0.231 | −0.192 | 3.670 |
| | 0.237 | −0.207 | 3.670 |
| | 0.243 | −0.221 | 3.670 |
| | 0.249 | −0.235 | 3.670 |
| | 0.255 | −0.249 | 3.670 |
| | 0.261 | −0.263 | 3.670 |
| | 0.267 | −0.277 | 3.670 |
| | 0.273 | −0.292 | 3.670 |
| | 0.279 | −0.306 | 3.670 |
| | 0.284 | −0.320 | 3.670 |
| | 0.274 | −0.329 | 3.670 |
| | 0.265 | −0.317 | 3.670 |
| | 0.258 | −0.304 | 3.670 |
| | 0.251 | −0.290 | 3.670 |
| | 0.244 | −0.276 | 3.670 |
| | 0.236 | −0.263 | 3.670 |
| | 0.229 | −0.250 | 3.670 |
| | 0.221 | −0.236 | 3.670 |
| | 0.213 | −0.223 | 3.670 |
| | 0.205 | −0.210 | 3.670 |
| | 0.197 | −0.197 | 3.670 |
| | 0.188 | −0.184 | 3.670 |
| | 0.180 | −0.171 | 3.670 |
| | 0.171 | −0.159 | 3.670 |
| | 0.162 | −0.146 | 3.670 |
| | 0.153 | −0.134 | 3.670 |
| | 0.143 | −0.122 | 3.670 |
| | 0.133 | −0.110 | 3.670 |
| | 0.123 | −0.099 | 3.670 |
| | 0.112 | −0.088 | 3.670 |
| | 0.101 | −0.077 | 3.670 |
| | 0.090 | −0.067 | 3.670 |
| | 0.078 | −0.057 | 3.670 |
| | 0.066 | −0.047 | 3.670 |
| | 0.053 | −0.038 | 3.670 |
| | 0.040 | −0.030 | 3.670 |
| | 0.027 | −0.022 | 3.670 |
| | 0.013 | −0.015 | 3.670 |
| | −0.001 | −0.009 | 3.670 |
| | −0.015 | −0.004 | 3.670 |
| | −0.030 | 0.000 | 3.670 |
| | −0.045 | 0.002 | 3.670 |
| | −0.061 | 0.003 | 3.670 |
| | −0.076 | 0.003 | 3.670 |
| | −0.091 | 0.001 | 3.670 |
| | −0.107 | −0.002 | 3.670 |
| | −0.121 | −0.006 | 3.670 |
| | −0.136 | −0.011 | 3.670 |
| | −0.150 | −0.016 | 3.670 |
| | −0.164 | −0.023 | 3.670 |
| | −0.178 | −0.030 | 3.670 |
| | −0.191 | −0.038 | 3.670 |
| SECTION 4 | −0.204 | −0.023 | 3.830 |
| | −0.217 | −0.017 | 3.830 |
| | −0.218 | −0.002 | 3.830 |
| | −0.216 | 0.013 | 3.830 |
| | −0.212 | 0.027 | 3.830 |
| | −0.206 | 0.041 | 3.830 |
| | −0.198 | 0.054 | 3.830 |
| | −0.190 | 0.066 | 3.830 |
| | −0.181 | 0.078 | 3.830 |
| | −0.171 | 0.090 | 3.830 |
| | −0.161 | 0.100 | 3.830 |
| | −0.149 | 0.109 | 3.830 |
| | −0.136 | 0.118 | 3.830 |
| | −0.123 | 0.124 | 3.830 |
| | −0.109 | 0.130 | 3.830 |
| | −0.095 | 0.134 | 3.830 |

TABLE 1-continued

| X | Y | Z |
|---|---|---|
| −0.080 | 0.137 | 3.830 |
| −0.065 | 0.137 | 3.830 |
| −0.050 | 0.137 | 3.830 |
| −0.035 | 0.134 | 3.830 |
| −0.021 | 0.131 | 3.830 |
| −0.006 | 0.126 | 3.830 |
| 0.007 | 0.119 | 3.830 |
| 0.020 | 0.112 | 3.830 |
| 0.033 | 0.104 | 3.830 |
| 0.045 | 0.095 | 3.830 |
| 0.056 | 0.085 | 3.830 |
| 0.067 | 0.075 | 3.830 |
| 0.077 | 0.064 | 3.830 |
| 0.087 | 0.053 | 3.830 |
| 0.097 | 0.041 | 3.830 |
| 0.106 | 0.029 | 3.830 |
| 0.114 | 0.017 | 3.830 |
| 0.122 | 0.004 | 3.830 |
| 0.130 | −0.009 | 3.830 |
| 0.138 | −0.022 | 3.830 |
| 0.145 | −0.035 | 3.830 |
| 0.152 | −0.048 | 3.830 |
| 0.159 | −0.062 | 3.830 |
| 0.165 | −0.075 | 3.830 |
| 0.171 | −0.089 | 3.830 |
| 0.178 | −0.102 | 3.830 |
| 0.184 | −0.116 | 3.830 |
| 0.190 | −0.130 | 3.830 |
| 0.196 | −0.143 | 3.830 |
| 0.202 | −0.157 | 3.830 |
| 0.207 | −0.171 | 3.830 |
| 0.213 | −0.185 | 3.830 |
| 0.219 | −0.199 | 3.830 |
| 0.225 | −0.212 | 3.830 |
| 0.231 | −0.226 | 3.830 |
| 0.237 | −0.240 | 3.830 |
| 0.242 | −0.254 | 3.830 |
| 0.248 | −0.268 | 3.830 |
| 0.254 | −0.282 | 3.830 |
| 0.260 | −0.296 | 3.830 |
| 0.265 | −0.309 | 3.830 |
| 0.262 | −0.322 | 3.830 |
| 0.250 | −0.318 | 3.830 |
| 0.243 | −0.305 | 3.830 |
| 0.236 | −0.291 | 3.830 |
| 0.230 | −0.278 | 3.830 |
| 0.223 | −0.265 | 3.830 |
| 0.216 | −0.252 | 3.830 |
| 0.208 | −0.238 | 3.830 |
| 0.201 | −0.225 | 3.830 |
| 0.194 | −0.212 | 3.830 |
| 0.186 | −0.199 | 3.830 |
| 0.179 | −0.186 | 3.830 |
| 0.171 | −0.174 | 3.830 |
| 0.163 | −0.161 | 3.830 |
| 0.154 | −0.149 | 3.830 |
| 0.146 | −0.136 | 3.830 |
| 0.137 | −0.124 | 3.830 |
| 0.128 | −0.112 | 3.830 |
| 0.119 | −0.100 | 3.830 |
| 0.109 | −0.089 | 3.830 |
| 0.099 | −0.078 | 3.830 |
| 0.089 | −0.066 | 3.830 |
| 0.079 | −0.056 | 3.830 |
| 0.068 | −0.045 | 3.830 |
| 0.057 | −0.035 | 3.830 |
| 0.046 | −0.025 | 3.830 |
| 0.034 | −0.016 | 3.830 |
| 0.022 | −0.007 | 3.830 |
| 0.009 | 0.000 | 3.830 |
| −0.005 | 0.007 | 3.830 |
| −0.019 | 0.012 | 3.830 |
| −0.033 | 0.016 | 3.830 |
| −0.048 | 0.019 | 3.830 |
| −0.063 | 0.020 | 3.830 |
| −0.078 | 0.020 | 3.830 |
| −0.093 | 0.019 | 3.830 |
| −0.108 | 0.016 | 3.830 |

TABLE 1-continued

| | X | Y | Z |
|---|---|---|---|
| | −0.122 | 0.013 | 3.830 |
| | −0.137 | 0.008 | 3.830 |
| | −0.151 | 0.003 | 3.830 |
| | −0.164 | −0.003 | 3.830 |
| | −0.178 | −0.010 | 3.830 |
| | −0.191 | −0.017 | 3.830 |
| SECTION 5 | −0.203 | −0.003 | 3.990 |
| | −0.216 | 0.001 | 3.990 |
| | −0.219 | 0.014 | 3.990 |
| | −0.216 | 0.028 | 3.990 |
| | −0.211 | 0.041 | 3.990 |
| | −0.204 | 0.054 | 3.990 |
| | −0.196 | 0.065 | 3.990 |
| | −0.188 | 0.077 | 3.990 |
| | −0.179 | 0.088 | 3.990 |
| | −0.169 | 0.098 | 3.990 |
| | −0.159 | 0.107 | 3.990 |
| | −0.147 | 0.115 | 3.990 |
| | −0.135 | 0.123 | 3.990 |
| | −0.122 | 0.128 | 3.990 |
| | −0.109 | 0.133 | 3.990 |
| | −0.095 | 0.136 | 3.990 |
| | −0.081 | 0.138 | 3.990 |
| | −0.067 | 0.138 | 3.990 |
| | −0.053 | 0.137 | 3.990 |
| | −0.039 | 0.134 | 3.990 |
| | −0.026 | 0.130 | 3.990 |
| | −0.013 | 0.125 | 3.990 |
| | 0.000 | 0.119 | 3.990 |
| | 0.012 | 0.112 | 3.990 |
| | 0.024 | 0.104 | 3.990 |
| | 0.035 | 0.095 | 3.990 |
| | 0.046 | 0.086 | 3.990 |
| | 0.056 | 0.076 | 3.990 |
| | 0.066 | 0.066 | 3.990 |
| | 0.075 | 0.055 | 3.990 |
| | 0.084 | 0.044 | 3.990 |
| | 0.092 | 0.033 | 3.990 |
| | 0.100 | 0.021 | 3.990 |
| | 0.108 | 0.010 | 3.990 |
| | 0.115 | −0.002 | 3.990 |
| | 0.122 | −0.015 | 3.990 |
| | 0.129 | −0.027 | 3.990 |
| | 0.135 | −0.040 | 3.990 |
| | 0.142 | −0.052 | 3.990 |
| | 0.148 | −0.065 | 3.990 |
| | 0.154 | −0.078 | 3.990 |
| | 0.160 | −0.090 | 3.990 |
| | 0.165 | −0.103 | 3.990 |
| | 0.171 | −0.116 | 3.990 |
| | 0.177 | −0.129 | 3.990 |
| | 0.182 | −0.142 | 3.990 |
| | 0.187 | −0.155 | 3.990 |
| | 0.193 | −0.168 | 3.990 |
| | 0.198 | −0.181 | 3.990 |
| | 0.204 | −0.194 | 3.990 |
| | 0.209 | −0.207 | 3.990 |
| | 0.214 | −0.220 | 3.990 |
| | 0.220 | −0.233 | 3.990 |
| | 0.225 | −0.246 | 3.990 |
| | 0.230 | −0.260 | 3.990 |
| | 0.236 | −0.273 | 3.990 |
| | 0.240 | −0.286 | 3.990 |
| | 0.231 | −0.295 | 3.990 |
| | 0.220 | −0.288 | 3.990 |
| | 0.214 | −0.276 | 3.990 |
| | 0.207 | −0.263 | 3.990 |
| | 0.201 | −0.251 | 3.990 |
| | 0.194 | −0.238 | 3.990 |
| | 0.188 | −0.226 | 3.990 |
| | 0.181 | −0.213 | 3.990 |
| | 0.175 | −0.201 | 3.990 |
| | 0.168 | −0.189 | 3.990 |
| | 0.161 | −0.176 | 3.990 |
| | 0.153 | −0.164 | 3.990 |
| | 0.146 | −0.152 | 3.990 |
| | 0.139 | −0.140 | 3.990 |
| | 0.131 | −0.129 | 3.990 |

TABLE 1-continued

| | X | Y | Z |
|---|---|---|---|
| | 0.123 | −0.117 | 3.990 |
| | 0.115 | −0.105 | 3.990 |
| | 0.106 | −0.094 | 3.990 |
| | 0.098 | −0.083 | 3.990 |
| | 0.089 | −0.072 | 3.990 |
| | 0.080 | −0.061 | 3.990 |
| | 0.071 | −0.050 | 3.990 |
| | 0.062 | −0.039 | 3.990 |
| | 0.052 | −0.029 | 3.990 |
| | 0.042 | −0.019 | 3.990 |
| | 0.032 | −0.010 | 3.990 |
| | 0.021 | −0.001 | 3.990 |
| | 0.010 | 0.008 | 3.990 |
| | −0.002 | 0.015 | 3.990 |
| | −0.015 | 0.022 | 3.990 |
| | −0.028 | 0.027 | 3.990 |
| | −0.041 | 0.031 | 3.990 |
| | −0.055 | 0.034 | 3.990 |
| | −0.069 | 0.035 | 3.990 |
| | −0.083 | 0.036 | 3.990 |
| | −0.097 | 0.035 | 3.990 |
| | −0.111 | 0.033 | 3.990 |
| | −0.125 | 0.030 | 3.990 |
| | −0.139 | 0.026 | 3.990 |
| | −0.152 | 0.021 | 3.990 |
| | −0.165 | 0.016 | 3.990 |
| | −0.178 | 0.010 | 3.990 |
| | −0.190 | 0.003 | 3.990 |
| SECTION 6 | −0.203 | 0.018 | 4.150 |
| | −0.215 | 0.020 | 4.150 |
| | −0.218 | 0.032 | 4.150 |
| | −0.214 | 0.044 | 4.150 |
| | −0.208 | 0.056 | 4.150 |
| | −0.200 | 0.067 | 4.150 |
| | −0.193 | 0.078 | 4.150 |
| | −0.184 | 0.088 | 4.150 |
| | −0.175 | 0.097 | 4.150 |
| | −0.165 | 0.106 | 4.150 |
| | −0.155 | 0.114 | 4.150 |
| | −0.144 | 0.121 | 4.150 |
| | −0.132 | 0.127 | 4.150 |
| | −0.120 | 0.132 | 4.150 |
| | −0.107 | 0.136 | 4.150 |
| | −0.094 | 0.138 | 4.150 |
| | −0.081 | 0.139 | 4.150 |
| | −0.068 | 0.138 | 4.150 |
| | −0.055 | 0.136 | 4.150 |
| | −0.042 | 0.133 | 4.150 |
| | −0.029 | 0.129 | 4.150 |
| | −0.017 | 0.124 | 4.150 |
| | −0.006 | 0.118 | 4.150 |
| | 0.006 | 0.111 | 4.150 |
| | 0.017 | 0.103 | 4.150 |
| | 0.027 | 0.095 | 4.150 |
| | 0.037 | 0.086 | 4.150 |
| | 0.046 | 0.077 | 4.150 |
| | 0.055 | 0.067 | 4.150 |
| | 0.064 | 0.057 | 4.150 |
| | 0.072 | 0.047 | 4.150 |
| | 0.080 | 0.036 | 4.150 |
| | 0.087 | 0.025 | 4.150 |
| | 0.094 | 0.014 | 4.150 |
| | 0.101 | 0.003 | 4.150 |
| | 0.108 | −0.009 | 4.150 |
| | 0.114 | −0.020 | 4.150 |
| | 0.120 | −0.032 | 4.150 |
| | 0.126 | −0.044 | 4.150 |
| | 0.132 | −0.056 | 4.150 |
| | 0.137 | −0.068 | 4.150 |
| | 0.143 | −0.080 | 4.150 |
| | 0.148 | −0.092 | 4.150 |
| | 0.153 | −0.104 | 4.150 |
| | 0.159 | −0.116 | 4.150 |
| | 0.164 | −0.128 | 4.150 |
| | 0.169 | −0.140 | 4.150 |
| | 0.174 | −0.153 | 4.150 |
| | 0.178 | −0.165 | 4.150 |
| | 0.183 | −0.177 | 4.150 |

TABLE 1-continued

| X | Y | Z |
|---|---|---|
| 0.188 | −0.189 | 4.150 |
| 0.193 | −0.202 | 4.150 |
| 0.198 | −0.214 | 4.150 |
| 0.203 | −0.226 | 4.150 |
| 0.208 | −0.238 | 4.150 |
| 0.213 | −0.251 | 4.150 |
| 0.210 | −0.262 | 4.150 |
| 0.198 | −0.266 | 4.150 |
| 0.190 | −0.257 | 4.150 |
| 0.184 | −0.245 | 4.150 |
| 0.178 | −0.233 | 4.150 |
| 0.173 | −0.221 | 4.150 |
| 0.167 | −0.209 | 4.150 |
| 0.161 | −0.198 | 4.150 |
| 0.154 | −0.186 | 4.150 |
| 0.148 | −0.174 | 4.150 |
| 0.142 | −0.163 | 4.150 |
| 0.135 | −0.151 | 4.150 |
| 0.128 | −0.140 | 4.150 |
| 0.121 | −0.129 | 4.150 |
| 0.114 | −0.118 | 4.150 |
| 0.107 | −0.107 | 4.150 |
| 0.100 | −0.096 | 4.150 |
| 0.092 | −0.085 | 4.150 |
| 0.085 | −0.074 | 4.150 |
| 0.077 | −0.063 | 4.150 |
| 0.069 | −0.053 | 4.150 |
| 0.061 | −0.042 | 4.150 |
| 0.053 | −0.032 | 4.150 |
| 0.044 | −0.022 | 4.150 |
| 0.036 | −0.012 | 4.150 |
| 0.027 | −0.002 | 4.150 |
| 0.017 | 0.007 | 4.150 |
| 0.007 | 0.016 | 4.150 |
| −0.004 | 0.023 | 4.150 |
| −0.015 | 0.031 | 4.150 |
| −0.026 | 0.037 | 4.150 |
| −0.038 | 0.042 | 4.150 |
| −0.051 | 0.046 | 4.150 |
| −0.064 | 0.049 | 4.150 |
| −0.077 | 0.051 | 4.150 |
| −0.090 | 0.051 | 4.150 |
| −0.103 | 0.050 | 4.150 |
| −0.116 | 0.049 | 4.150 |
| −0.129 | 0.046 | 4.150 |
| −0.142 | 0.043 | 4.150 |
| −0.155 | 0.039 | 4.150 |
| −0.167 | 0.034 | 4.150 |
| −0.179 | 0.029 | 4.150 |
| −0.191 | 0.023 | 4.150 |

All the sections (i.e. sections 1 to 6 inclusively) defined in Table 1 are fully comprised between the inner and outer boundaries 28 and 30 of the gaspath 27. Section 1 corresponds to an airfoil section located slightly above the root fillet between the airfoil 56 and the platform 64. Section 6 corresponds to an airfoil section located slightly below the airfoil tip 62. The airfoil profile proximal to the platform 64 and the tip 62 may vary due to several imposed constraints and are not defined by one of the above profile section. For example, in a particular embodiment in which the tip 62 is angled, multiple tip 62 cross-sections would not be defined by a profile section 70. Notably, it should be considered that the airfoil profile proximal to the platform 64 may vary due to several imposed constraints. The skilled reader will appreciate that a suitable fillet radius is to be applied between the wall 28 (i.e. blade platform) and the airfoil portion 56 of the blade 42, and that a suitable blade tip clearance is to be provided between tip 62 and outer wall 30. However, the HPT blade 42 has a main intermediate airfoil portion 68 defined between the platform 64 and the tip 62 thereof and which has a profile defined on the basis of the profile sections 70 defined in Table 1.

The above profile definition provides for an increase of the thickness of the pressure side 57 of the blade 42 from mid span on the blade down to the platform 64. The lower end portion thickening of the airfoil 56 of the turbine blade 42 provides added stiffness and contributes to improve the dynamic behaviour of the blade 42. The pressure side 57 is thickened as it is less sensitive in terms of changing performance. It has been found that the additional material on the central lower portion of the pressure side 57 helped in terms of dynamics by reducing airfoil vibrations without impacting performance. The profile defined by the above set of coordinates also provides for a trailing edge cutback 69 (FIG. 2) in the tip end portion of the blade 42. Approximately a 0.054" cutback is introduced at the tip to help dynamics and reduce vibrations while having a minimal impact on performance. Significant effort was spent on finalizing the size of the cutback to get the most improvement in dynamics possible while having as little an impact on performance. Large cutbacks are known to have a very adverse effect on performance. A detailed parametric study involving analysis and testing was undertaken to finalize the cutback 69.

The above description is meant to be exemplary only, and one skilled in the art will recognize that changes may be made to the embodiments described without departing from the scope of the invention disclosed. For example, the airfoil definition of Table 1 may be scaled geometrically, while maintaining the same proportional relationship and airfoil shape, for application to gas turbine engine of other sizes. Still other modifications which fall within the scope of the present invention will be apparent to those skilled in the art, in light of a review of this disclosure, and such modifications are intended to fall within the appended claims.

The invention claimed is:

1. A turbine blade for a gas turbine engine comprising an airfoil having an intermediate portion defined by a nominal profile substantially in accordance with Cartesian coordinate values of X, Y, and Z set forth in Table 1, wherein the point of origin of the orthogonally related axes X, Y and Z is located at an intersection of a centerline of the gas turbine engine and a stacking line of the turbine blade, the Z values are radial distances measured along the stacking line, the X and Y are coordinate values defining the profile at each distance Z.

2. The turbine blade as defined in claim 1 forming part of a high pressure turbine stage of the gas turbine engine.

3. The turbine blade as defined in claim 2, wherein the blade forms part of a single stage high pressure turbine.

4. The turbine blade as defined in claim 1, wherein the X and Y values are scalable as a function of the same constant or number.

5. The turbine blade as defined in claim 1, wherein the profile defined by the X and Y coordinate values have a manufacturing tolerance of ±0.003 inch.

6. The turbine blade as defined in claim 5, wherein the nominal profile defining the intermediate portion is for an uncoated airfoil, and wherein a coating having a thickness of 0.001 inch to 0.002 inch is applied to the uncoated airfoil.

7. The turbine blade as defined in claim 1, wherein X and Y values define a set of points for each Z value which when connected by smooth continuing arcs define an airfoil profile section, the profile sections at the Z distances being joined smoothly with one another to form an airfoil shape of the intermediate portion.

8. A turbine blade for a gas turbine engine comprising an airfoil having an intermediate portion at least partly defined by a nominal profile substantially in accordance with Cartesian coordinate values of X, Y, and Z set forth in Table 1, wherein the point of origin of the orthogonally related axes X, Y and Z is located at an intersection of a centerline of the gas turbine engine and a stacking line of the turbine blade in the engine, the Z values are radial distances measured along the stacking line of the airfoil, the X and Y are coordinate values defining the profile at each distance Z, and wherein the X and Y values are scalable as a function of the same constant or number.

9. The turbine blade as defined in claim 8 forming part of a blade of a high pressure turbine stage of the gas turbine engine.

10. The turbine blade as defined in claim 9, wherein the blade is of a single stage high pressure turbine.

11. The turbine blade as defined in claim 8, wherein the profile defined by the X and Y coordinate values have a manufacturing tolerance of ±0.003 inch.

12. The turbine blade as defined in claim 11, wherein the nominal profile defining the intermediate portion is for an uncoated airfoil, and wherein a coating of 0.001 inch to 0.002 inch is applied to the uncoated airfoil.

13. The turbine blade as defined in claim 8, wherein X and Y values define a set of points for each Z value which when connected by smooth continuing arcs define an airfoil profile section, the profile sections at the Z distances being joined smoothly with one another to form an airfoil shape of the intermediate portion.

14. A turbine rotor for a gas turbine engine comprising a plurality of blades extending from a rotor disc, each blade including an airfoil having an intermediate portion defined by a nominal profile substantially in accordance with Cartesian coordinate values of X, Y, and Z set forth in Table 1, wherein the point of origin of the orthogonally related axes X, Y and Z is located at an intersection of a centerline of the gas turbine engine and a stacking line of the blades, the Z values are radial distances measured along the stacking line, the X and Y are coordinate values defining the profile at each distance Z.

15. A high pressure blade adapted to be mounted in a gaspath comprising a stacking line, the stacking line defining the position of the blade in the gaspath, the blade comprising an airfoil having a surface lying substantially on the points of Table 1.

* * * * *